US012025403B2

(12) United States Patent
Chia

(10) Patent No.: US 12,025,403 B2
(45) Date of Patent: Jul. 2, 2024

(54) TOY FLUID LAUNCHER AND METHOD OF USING SAME

(71) Applicants: EASEBON SERVICES LIMITED, Kwun Tong (HK); Francis See Chong Chia, Kowloon (HK)

(72) Inventor: Francis See Chong Chia, Kowloon (HK)

(73) Assignee: EASEBON SERVICES LIMITED, Kwun Tong (HK)

( * ) Notice: Subject to any disclaimer, the term of this patent is extended or adjusted under 35 U.S.C. 154(b) by 0 days.

(21) Appl. No.: 17/918,759

(22) PCT Filed: Apr. 12, 2021

(86) PCT No.: PCT/SG2021/050202
§ 371 (c)(1),
(2) Date: Oct. 13, 2022

(87) PCT Pub. No.: WO2021/211056
PCT Pub. Date: Oct. 21, 2021

(65) Prior Publication Data

US 2023/0136137 A1 May 4, 2023

Related U.S. Application Data

(60) Provisional application No. 63/009,564, filed on Apr. 14, 2020.

(51) Int. Cl.
*F41B 7/08* (2006.01)
*F41B 9/00* (2006.01)
(Continued)

(52) U.S. Cl.
CPC ..... *F41B 7/08* (2013.01); *F41B 9/0071* (2013.01); *F41B 11/646* (2013.01); *F41B 11/89* (2013.01)

(58) Field of Classification Search
CPC ..... F41B 7/08; F41B 9/0071; F41B 11/646; F41B 11/647; F41B 11/66; F41B 11/89
(Continued)

(56) References Cited

U.S. PATENT DOCUMENTS 1,164,646 A * 12/1915 Heyman et al. ..... F41B 11/89 124/66
1,240,991 A * 9/1917 Lefever ..... F41B 11/642 124/66
(Continued)

OTHER PUBLICATIONS

Written Opinion issued in International Application No. PCT/SG2021/05020, dated Jul. 28, 2021.
(Continued)

*Primary Examiner* — Alexander R Niconovich
(74) *Attorney, Agent, or Firm* — Amster, Rothstein & Ebenstein LLP

(57) ABSTRACT

A toy launcher having a telescopic barrel, a plunger element, and a compression spring that biases the plunger element against a rear wall of the telescopic barrel. When a cocking slide is moved from a forward position to a backward position, the plunger element partially compresses the compression spring against the rear wall of the telescopic barrel, while the plunger element couples to a trigger assembly. Fluid from a reservoir enters a fluid chamber formed by the plunger element and the front part of the telescopic barrel. When the cocking slide is moved from the backward position to the forward position, the rear part of the telescopic barrel fully compresses the compression spring. Fluid is expelled from the fluid chamber when the coupling between the plunger element and trigger assembly is released.

11 Claims, 4 Drawing Sheets

(51) Int. Cl.
*F41B 11/646* (2013.01)
*F41B 11/89* (2013.01)

(58) Field of Classification Search
USPC ..... 124/16, 37, 65, 66, 67
See application file for complete search history.

(56) References Cited

U.S. PATENT DOCUMENTS 1,509,257 A * 9/1924 Randall ..... F41A 9/18 124/40
1,094,237 A * 4/1941 Nash ..... A63H 5/04 446/181
2,685,284 A * 8/1954 Neal ..... F41B 11/647 124/40
3,302,523 A * 2/1967 Adams ..... F41A 9/23 89/33.03
3,465,741 A * 9/1969 Wesley ..... F41B 11/00 124/55
4,732,136 A * 3/1988 Ferri ..... F41B 11/55 124/67
5,193,517 A * 3/1993 Taylor ..... F41B 11/64 124/67
5,381,928 A * 1/1995 Lee ..... F41B 9/0065 222/386
6,067,975 A * 5/2000 Ginn ..... F41B 11/89 124/66
6,352,070 B1 * 3/2002 Mendoza-Orozco ..... F41B 11/642 124/66
7,481,209 B1 * 1/2009 Bligh ..... F41B 11/643 124/63
9,389,042 B1 * 7/2016 Clayton ..... F41B 11/642
9,534,865 B1 * 1/2017 Clayton ..... F41B 11/643
9,784,524 B1 * 10/2017 Ma ..... F41B 11/55
11,243,044 B2 * 2/2022 Chia ..... F41A 9/66
11,519,689 B2 * 12/2022 Chia ..... F41B 11/89
2012/0080019 A1 * 4/2012 Victor ..... F41B 7/003 124/16
2014/0165983 A1 * 6/2014 Busse ..... F41B 11/89 124/66
2014/0360482 A1 * 12/2014 Hadley ..... F41B 11/641 124/64
2019/0257611 A1 * 8/2019 Kim ..... F41B 11/89
2023/0175808 A1 * 6/2023 Chia ..... F41B 11/89 124/16
2023/0296337 A1 * 9/2023 Chia ..... F41A 9/19 124/71

OTHER PUBLICATIONS

International Search Report issued in International Application No. PCT/SG2021/05020, dated Jul. 28, 2021.

* cited by examiner

TOY FLUID LAUNCHER AND METHOD OF USING SAME

CROSS-REFERENCE TO RELATED APPLICATIONS

This application is a U.S. national stage entry under 35 U.S.C. § 371 of PCT International Patent Application No. PCT/SG2021/050202, filed Apr. 12, 2021, which claims the benefit of and priority to U.S. Provisional Patent Application No. 63/009,564, filed on Apr. 14, 2020, entitled "TOY FLUID LAUNCHER AND METHOD OF USING SAME," the contents of which are incorporated by reference herein in their entirety.

FIELD

The present disclosure is generally related to a toy fluid launcher, such as a toy water blaster, water gun, and the like, with a mechanism for increased launching force.

BACKGROUND

Traditional toy fluid launchers have utilized various forms of piston and plunger mechanisms for expelling fluid through a restricted opening. Such launchers often rely upon the physical strength of a user to increase the launching force and, consequently, the distance of the expelled fluid. Therefore, using such launchers may be tiring and a young player, or a physically challenged player, would lose out to more physically capable friends because how far one can shoot is directly related to muscle strength.

Various alternative mechanisms have been applied to toy fluid launchers to increase the volume of fluids launched and/or the distance the fluid is launched. For example, battery-operated motorized mechanisms have been used to provide for high-speed rapid-fire applications. However, due to the need for motors and water proofing, such mechanisms can be very expensive to produce. Additionally, due to the need for batteries, such mechanisms can be too heavy for younger users.

As another example, air pressure systems have been used to store multiple pumping strokes of a user to increase the launch pressure and corresponding distance of the launched fluid. However, such systems often require substantial pumping to build up pressure and the user can be vulnerable to attack while pumping during game play. Specifically, inflated bladder systems have been used but such systems still require substantial pumping and may have added expenses for quality bladders.

SUMMARY

To address the above, the present disclosure is generally related to an improved toy launcher for launching a fluid, such as a water blaster, water gun, water pistol, and the like. Particularly, the present disclosure is directed to a toy launcher with a simple construction for an improved step-wise priming (or "pumping" or "loading" or "cocking") mechanism that increases launching force without requiring excessive physical strength from the user. According to an exemplary embodiment, the toy launcher incorporates a spring-loaded piston (or reciprocating pump or syringe) that requires only one cocking motion while still providing for increased launching force, where the strength required to operate a strong spring is reduced by apportioning part of the loading stroke into the pull-back and forward return motions. Advantageously, the two-step priming mechanism reduces the strength required to load a strong spring, thus turning the launcher into a more user-friendly, high-velocity launcher that younger, or less physically capable, players can use to compete with their friends on a more equal footing. In addition, the simplified construction of the present disclosure also significantly reduces the material costs of the launcher in comparison to the above-described conventional mechanisms.

In accordance with an embodiment of the present disclosure, a toy launcher for launching a fluid includes a telescopic barrel; a plunger element engaged with the telescopic barrel; a compression spring that biases the plunger element against a rear wall of the telescopic barrel; a sliding handle coupled to one or more of the plunger element and the telescopic barrel, the sliding handle being movable between a forward position and a backward position; a latching assembly that couples the plunger element to a trigger assembly when the sliding handle is moved to the backward position; and the trigger assembly that, upon toggling, releases the coupling of the latching assembly between the plunger element and the trigger assembly.

In embodiments, the plunger element partially compresses the compression spring against the telescopic barrel when the sliding handle is moved to the backward position.

In embodiments, the telescopic barrel is extendible from a shorter length to a longer length when the sliding handle is moved to the backward position.

In embodiments, the toy launcher includes respective couplings between the sliding handle and each of the plunger element and the telescopic barrel, wherein the respective coupling between the sliding handle and telescopic barrel further compresses the partially compressed compression spring when the sliding handle is moved from the backward position to the forward position.

In embodiments, the telescopic barrel is compressed from the longer length to the shorter length when the sliding handle is moved from the backward position to the forward position.

In embodiments, the plunger element and the telescopic barrel form an internal fluid chamber when the sliding handle is moved to the backward position.

In embodiments, the telescopic barrel is connected to a fluid source, wherein a fluid from the fluid source is drawn into the internal fluid chamber when the sliding handle is moved to the backward position.

In embodiments, the plunger element is pushed forward by the compression spring to expel the fluid from the internal fluid chamber when the coupling of the latching assembly between the plunger element and the trigger assembly is released.

In embodiments, a toy launcher comprises a telescopic barrel having a front part and a rear part; a plunger element engaged by the telescopic barrel; a compression spring that biases the plunger element against a rear wall of the telescopic barrel; a cocking slide coupled to the telescopic barrel and the plunger element, the cocking slide being movable between a forward position and a backward position; wherein, when the cocking slide is moved from the forward position to the backward position the plunger element partially compresses the compression spring against the rear wall of the telescopic barrel; and wherein, when the cocking slide is moved from the backward position to the forward position, the rear part of the telescopic barrel fully compresses the compression spring against the rear wall of the telescopic barrel.

In embodiments, when the cocking slide is moved from the forward position to the backward position, the telescopic barrel extends from a shorter length to a longer length.

In embodiments, when the cocking slide is moved from the backward position to the forward position, the telescopic barrel is compressed from the longer length to the shorter length.

In embodiments, the toy launcher further comprises a latching assembly; and a trigger assembly; wherein the plunger element is coupled to the trigger assembly, and a fluid chamber is formed by the plunger element and the front part of the telescopic barrel.

In embodiments, the toy launcher further comprises an inlet into the fluid chamber, wherein, when the cocking slide is moved from the forward position to the backward position, a fluid is drawn into the fluid chamber from via the inlet.

In embodiments, the toy launcher further comprises a nozzle, wherein the nozzle has incorporated thereon a one-way flow valve that reduces air intake into the fluid chamber when the plunger element is moved toward the backward position.

In embodiments, when the coupling between the trigger assembly and the plunger element is released, the plunger element is pushed forward by the compression spring to expel the fluid from the fluid chamber through the nozzle.

In embodiments, the fluid is a liquid.

In embodiments, the fluid is air.

In embodiments, the toy launcher further comprises a rod extending from the plunger element, wherein the rod incorporates a catch element thereon, and wherein, when the cocking slide is moved from the forward position to the backward position, the cocking slide engages the catch element of the rod and moves the rod in a backward direction to cause the plunger element to partially compress the compression spring against the rear wall of the telescopic barrel.

In embodiments, the rod further incorporates a notched recess and a leading sloped edge, wherein the latching assembly includes an aperture and a spring-loaded plate, and wherein the plunger element is coupled to the trigger assembly via the latching assembly when the leading sloped edge of the rod engages the spring-loaded plate to push through the aperture of the latching assembly and the spring-loaded plate of the latching assembly engages the notched recess of the rod.

BRIEF DESCRIPTION OF THE DRAWINGS

Exemplary embodiments of the present disclosure will be described with reference to the accompanying figures, wherein.

DETAILED DESCRIPTION

The present disclosure is generally related to an improved toy launcher with a two-step priming (or "cocking") process for increasing launch velocity and force without requiring excessive physical strength from the user. To achieve this objective, according to an exemplary embodiment, a toy launcher incorporates a spring-loaded piston having a two-part barrel and a spring-biased plunger element that is coupled to a trigger mechanism on a first, pull-back, priming step. Thereafter, in a second, forward-return, priming step, a rear part of the two-part barrel having an internal fluid chamber is pushed forward while the plunger element is still coupled and anchored to the trigger mechanism, thus further compressing the spring of the plunger element. Upon triggering, the compressed spring is released and the plunger element is thereby pushed forward by the compressed spring to eject the fluid in the internal fluid chamber. Advantageously, the present disclosure provides for the spring compression in a two-step priming process that reduces the strength needed for doing so by dividing the compression into the fore and aft movement of the compressing means.

FIGS. 1A-1D are schematic partial cross-sectional views of key elements of a toy fluid launcher 100 in a priming and launching process according to an exemplary embodiment of the present disclosure. For clarity and simplicity in illustrating the key elements and mechanisms for facilitating the two-step priming process, extraneous portions—such as the external housing, fluid storage reservoir, and the like—are not shown. One of ordinary skill in the art would readily understand the housing elements needed to house and anchor the various illustrated elements as well as the reservoir for supplying the fluids to be launched with various design choices that would not depart from the spirit and scope of the present disclosure.

Figure 1A:
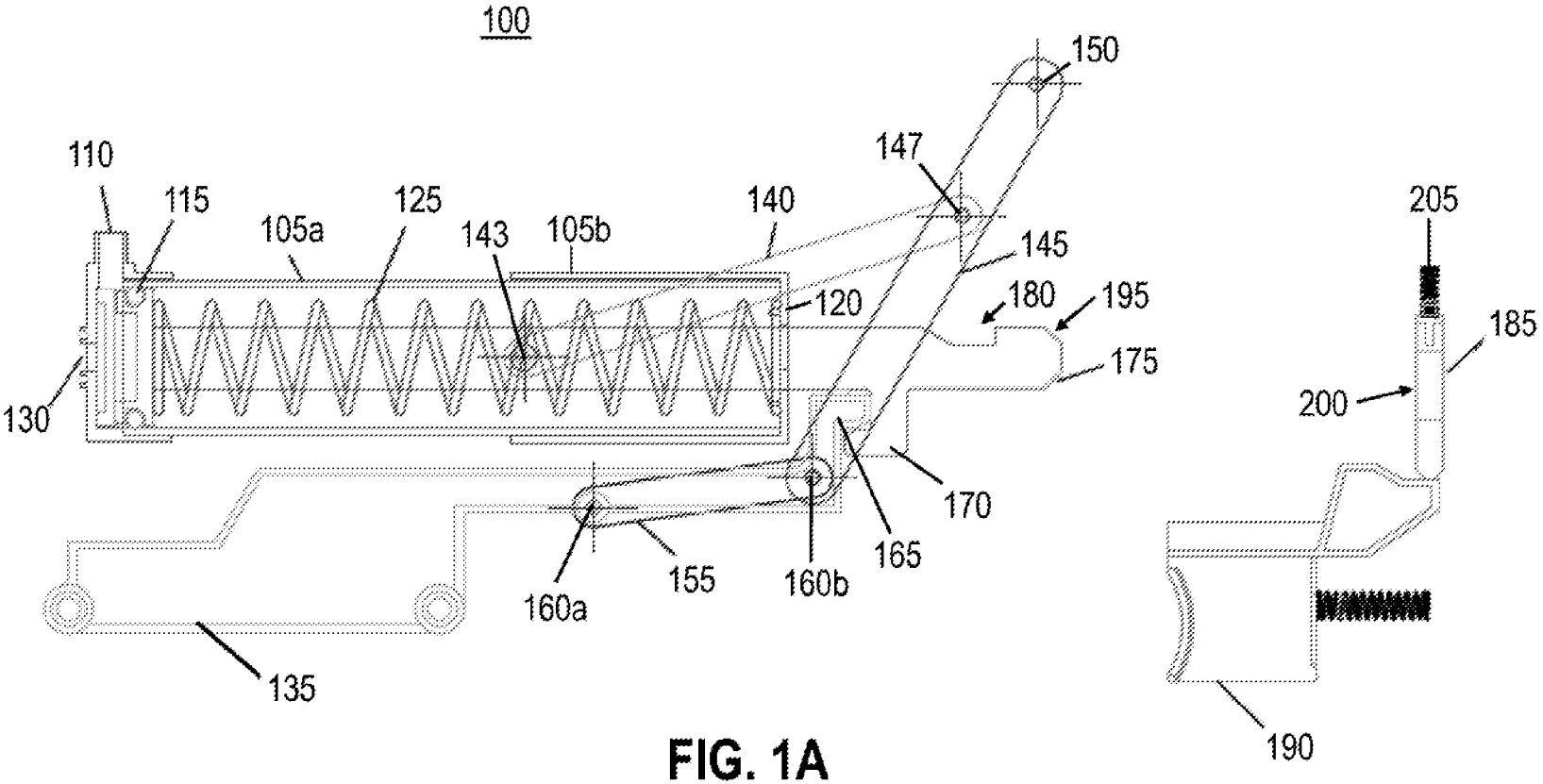
FIG. 1A is a schematic view of key elements of a toy fluid launcher in an initial, at-rest configuration in accordance with an exemplary embodiment of the present disclosure.

As shown in FIG. 1A, toy launcher 100 includes a two-part telescoping barrel 105*a* and 105*b*, in a form similar to an enlarged syringe barrel, where a front part of the barrel (105*a*) houses an internal fluid chamber 108 (see FIGS. 1B and 1C) allowing fluids from a reservoir (not shown) to be drawn through an inlet 110 when a water-tight plunger element 115 is pulled back. According to an exemplary embodiment, the two-part barrel 105*a* and 105*b* has a generally rounded cylindrical shape with a rear part 105*b* having a larger diameter that is in a slidable, telescopic relationship with the front part 105*a*. Plunger element 115 is biased against a back wall 120 of the rear part of the barrel 105*b* by a compression spring 125. As described above, compression spring 125 may be a higher rated spring—e.g., a 2.0 mm diameter spring having 16.5 coils and measuring about 170 mm long—with a higher spring force—e.g., requiring about 16 kg of force for full compression over a distance of about 125 mm (or approximately 75% of the full uncompressed length of the spring 125)—so that, when released, the fluid drawn into fluid chamber 105 is pushed forward and launched through nozzle 130 at a higher velocity or a greater volume of fluid per unit time than if the restorative force of the spring were lower.

As illustrated in FIG. 1A, the rear part of the barrel 105*b* is coupled to a sliding forearm handle or cocking slide 135 via an assembly of rotatable/hinged couplings that together operate to ensure motion alignment among the elements. The elements include a reciprocating connector rod 140 coupled to a side of the rear part of the barrel 105*b* (at a rotatable coupling point 143), an anchor bar 145 that is coupled to reciprocating connector rod 140 (at a rotatable coupling point 147) and that is anchored on a fixed pivot 150 in the housing (not shown) of the launcher, and a stabilizer/reinforcement bar 155 that is coupled to cocking slide 135 (at coupling points 160*a* and 160*b*) and that reinforces a rotatable coupling of cocking slide 135 to anchor bar 145 (at coupling point 160*b*). According to an exemplary embodiment, the rotatable couplings are disposed on both sides of barrel (105*b*) and cocking slide 135. Thus, anchor bar 145 may be embodied by a U-shaped element, a Y-shaped element, or the like, that incorporates respective couplings to the two sides of rear part 105*b* of the barrel and cocking slide 135, respectively—e.g., via respective rotatable connectors (140) to each side of the barrel (rear part 105*b*). In embodiments, a corresponding assembly of rotatable couplings, as illustrated in FIGS. 1A-1D, may be incorporated on each side of the launcher and anchored to respective anchor points 160 in the housing (not shown) corresponding to the respective sides of the launcher 100.

As further illustrated in FIG. 1A, cocking slide 135 incorporates a catch element 165 that engages a corresponding catch element 170 on a rod portion 175 extending from plunger element 115. As will be described in further detail below with reference to FIG. 1B, the engagement between catch elements 165 and 170 of cocking slide 135 and rod portion 175, respectively, allows a user to pull back plunger element 115 using cocking slide 135 in a first, pull-back, priming step. Correspondingly, rod portion 175 further incorporates a notch/recess 180 and a leading sloped edge/notch 195 that are configured to interact with an aperture 200 through a spring-loaded plate/block 185. As illustrated in FIG. 1A, plate/block 185 is coupled to a compression spring 205 that biases plate/block 185 downward towards a trigger assembly 190.

Figure 1B:
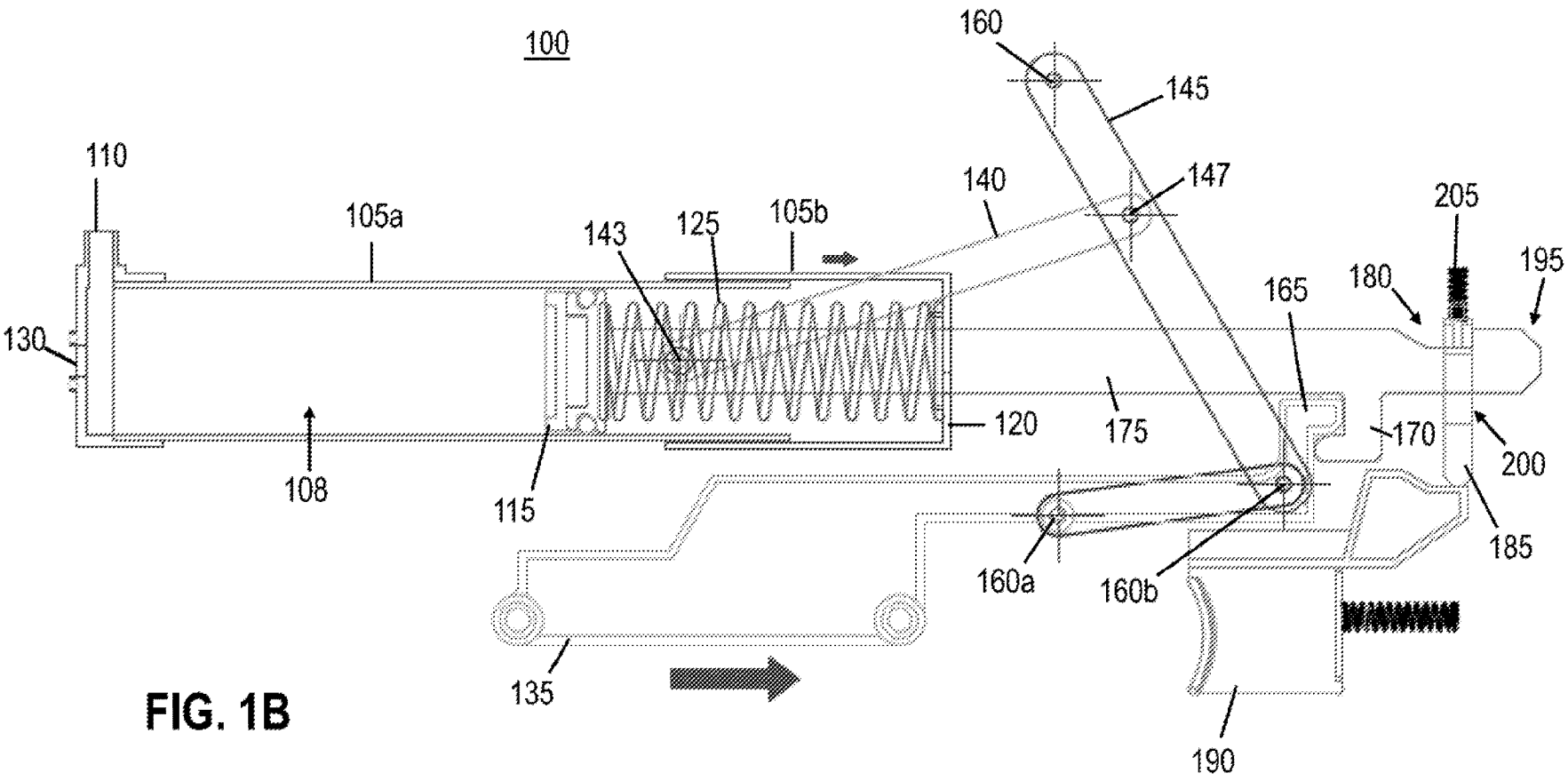
FIG. 1B is a schematic view of key elements of the toy fluid launcher in a first, pull-back, priming step in accordance with an exemplary embodiment of the present disclosure.

Referring now to FIG. 1B, when a user pulls cocking slide 135 backward in a fashion similar to a pump action shotgun (see bottom arrow in FIG. 1B), catch element 165 pushes on catch element 170 so that rod portion 175 is pushed back as well. According to an exemplary embodiment of the disclosure, rod portion 175 is pushed backward so that leading sloped edge/notch 195 pushes upward on a top edge of aperture 200 in plate/block 185, compressing spring 205, so that rod portion 175 can be pushed through aperture 200 from the front of plate/block 185 to clear an opposing back side of plate/block 185, as illustrated in FIG. 1B. Once rod portion 175 is pushed sufficiently past plate/block 185 through aperture 200, spring 205 moves plate/block 185 downward into engagement with the face of notch/recess 180 so that rod portion 175—and, correspondingly, plunger element 115—is engaged with, and temporarily retained in place by plate/block 185. As shown in FIG. 1B, a leading internal surface of notch/recess 180 hooks to the opposing back side of plate/block 185 above aperture 200 once plate/block 185 is pushed downward by compression spring 205 into notch/recess 180 and, accordingly, a top edge of aperture 200 is pushed into a bottom surface of notch/recess 180.

As further shown in FIG. 1B, with plunger element 115 being pulled back by rod portion 175, spring 125 is partially compressed while plunger element 115 forms a chamber 108 with front portion 105*a* of the barrel so that fluids can be pulled in—by vacuum—through inlet 110 from a fluid source (not shown), such as a reservoir or the like—the internal fluid chamber 108 holding the primed fluids from the fluid source for launch. In embodiments, nozzle 130 may incorporate a substantially one-way flow valve that reduces air intake when plunger element 115 is drawn backwards so as to improve the suction on inlet 110 for drawing liquids into the chamber formed by plunger element 115 and front portion 105*a* of the barrel. Additionally, nozzle 130 may incorporate a valve that prevents fluid release unless under high pressure—i.e., during launch—from internal fluid chamber 108.

According to an exemplary embodiment of the present disclosure and as illustrated in FIG. 1B, the plunger element 115 compresses spring 125 against the back wall 120 of the rear part 105*b* of the barrel and the compression spring 125, therefore, exerts a backward force on the back wall 120. Additionally, reciprocating connector rod 140 is pivoted backwards by anchor bar 145 as anchor bar 145 itself is pivoted backward by cocking slide 135 with fixed anchor point 160 serving as the fulcrum. Consequently, rear part 105*b* slides and extends backwards from front part 105*a* of the barrel via the backward force exerted by spring 125 and reciprocating connector rod 140. This slide and extension of the rear part 105*b* from the front part 105*a* eases and reduces the compression of spring 125 and, thus, the force needed to pull cocking slide 135 backward toward the position at which plate/block 185 and notch/recess 180 are hooked and engaged with each other—and, correspondingly, the full extension of rod portion 175 and plunger element 115 in the backward direction to form internal fluid chamber 108. According to an exemplary embodiment of the present disclosure, rod 140 and bar 145, along with the extension of rear part 105*b* from front part 105*a*, are dimensioned so that, on average when utilizing the aforementioned spring 125 requiring a total force of approximately 16 kg for full compression, about 9.3 kg of force is needed to pull cocking slide 135 from the forward default position to the backward position at which plate/block 185 and notch/recess 180 are engaged with each other in the first, pull-back, priming step. In embodiments, a structural stop (not shown) may be used to limit the backward motion of cocking slide 135 to the above full extension position—i.e., the engagement position between notch/recess 180 and plate/block 185.

Figure 1C:
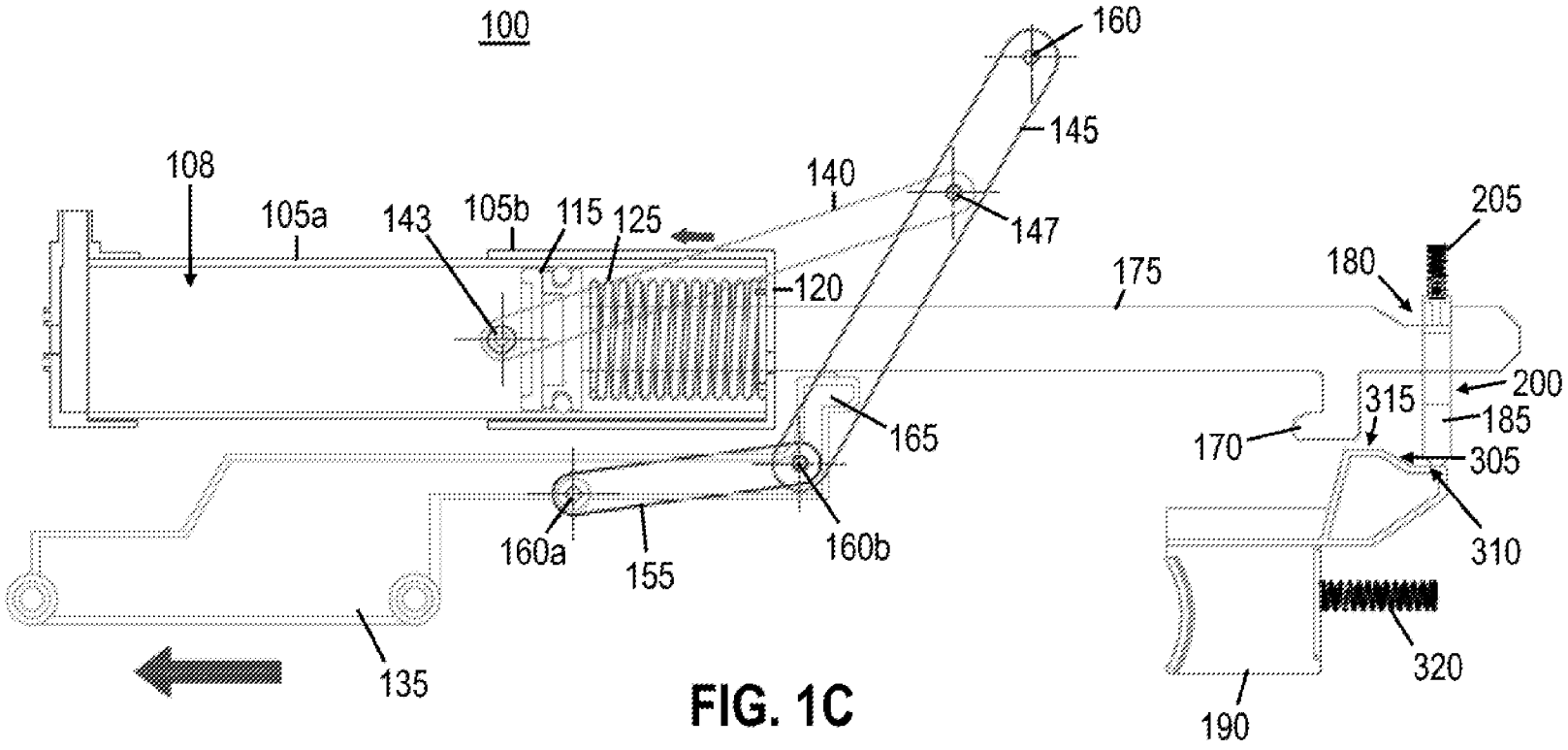
FIG. 1C is a schematic view of key elements of the toy fluid launcher in a second, forward-return, priming step in accordance with an exemplary embodiment of the present disclosure.

Next, referring to FIG. 1C, once the notch/recess 180 of rod portion is interlocked/engaged with plate/block 185 via the downward bias of spring 205, the user can push cocking slide 135 forward in a second priming step—again, in a similar fashion to a pump action shotgun (see bottom arrow in FIG. 1C). Consequently, anchor bar 145 pivots forward at coupling point 160*b* in following the forward motion of cocking slide 135 and, in turn, compels reciprocal coupling (connector rod) 140 to exert a forward force on rear part 105*b* of the barrel. Additionally, according to an exemplary embodiment of the present disclosure, catch element 165 may engage the back wall 120 of rear part 105*b* during the forward motion of cocking slide 135. Thus, reciprocating connector rod 140 and catch element 165 may together compel rear part 105*b* to slide forward towards front part 105*a*, further compressing spring 125. As shown in FIG. 1C, compression spring 125 is fully compressed by the return of cocking slide 135 to the original forward position. Advantageously, the two-step priming/pumping action described above divides and reduces the force needed to fully compress spring 125—thus, allowing for a stronger launch force without requiring undue strength by the user to compress spring 125. As described above, rod 140 and bar 145, along with the extension of rear part 105*b* from front part 105*a*, are dimensioned so that, on average when utilizing the aforementioned spring 125 requiring a total force of approximately 16 kg for full compression, about 9.3 kg of force is needed to pull cocking slide 135 from the forward default position to the backward position at which plate/block 185 and notch/recess 180 are engaged with each other in the first, pull-back, priming step. Correspondingly, these elements are dimensioned so that, on average when utilizing the aforementioned spring 125 requiring a total force of approximately 16 kg for full compression, about 5.3 kg of force is needed to push cocking slide 135 from the backward first priming position back to the original forward default position in the second priming step. Accordingly, the full force needed to fully compress spring 125 may be apportioned and divided at an approximate 1.75:1 ratio between the first, pull-back, priming step and the second, push-forward, priming step. It has been found that a user, on average, is able to exert more force on the first, pull-back, priming step than on the second, push-forward, priming step. Therefore, in embodiments, the elements may be dimensioned so that the force is apportioned and divided at a ratio from about 1:1 and above, for example, to about 2:1.

As shown in FIG. 1C, the volume of internal fluid chamber 108 formed by plunger element 115 and front part 105*a* is retained and unaffected by the forward compression of spring 125 and rear part 105*b*. Thus, the full volume of fluids in chamber 108 can be launched by a fully compressed spring 125.

Next, a trigger pull and launch action will be described. As illustrated in FIG. 1C, trigger assembly 190 includes an inclined surface 305 between a lower surface 310 and an upper surface 315—which collectively form a top camming surface of trigger assembly 190 so that, when trigger assembly 190 is pulled backward by the user, plate/block 185 is caused to move upward from the lower surface 310 to the upper surface 315 against spring 205. As also illustrated in FIG. 1C, trigger assembly 190 is biased forward in a default position by spring 320 such that plate/block 185 abuts the lower surface 310 when trigger 190 is in the forward, default, non-firing position.

Figure 1D:
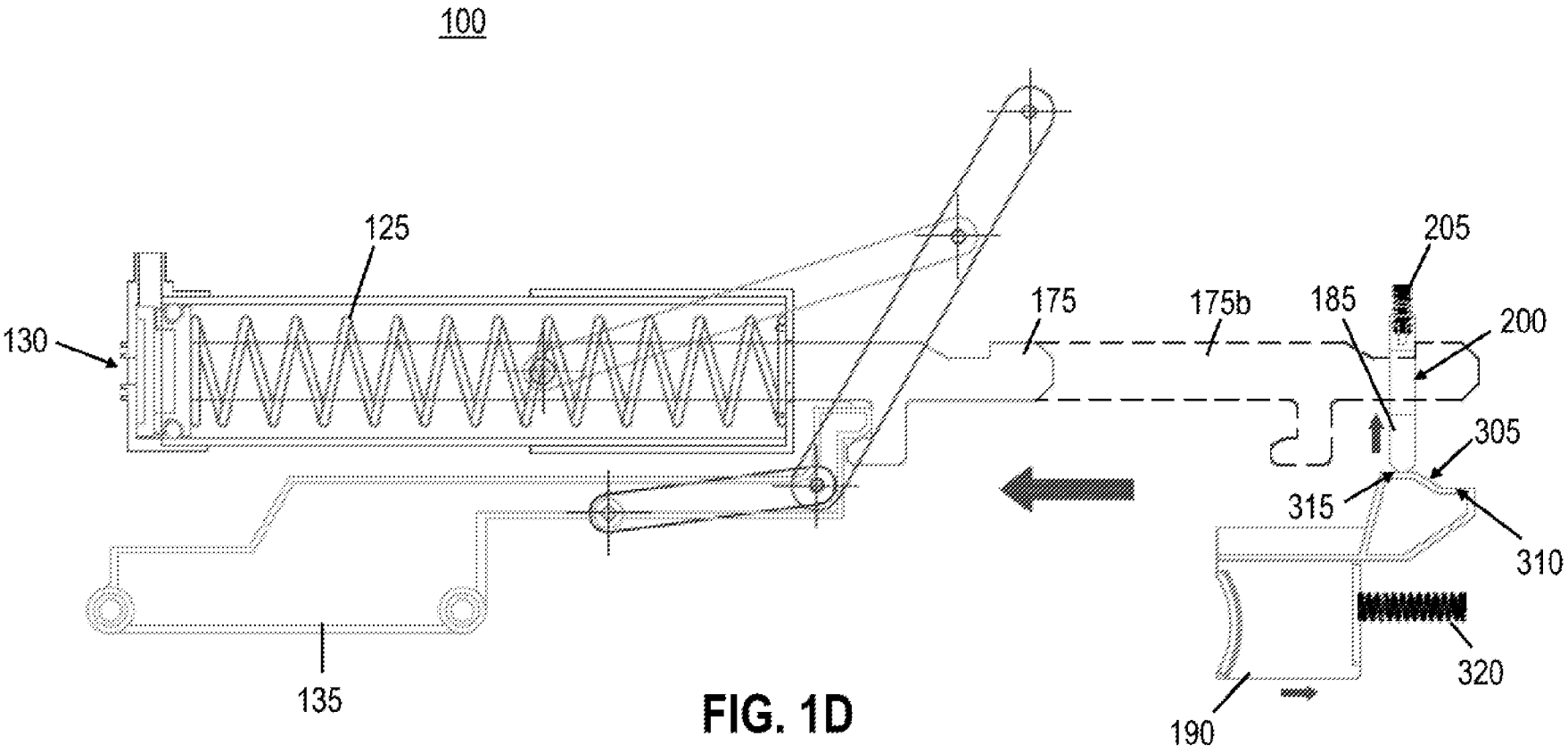
FIG. 1D is a schematic view of key elements of the toy fluid launcher during a launch according to an exemplary embodiment of the present disclosure.

FIG. 1D illustrates the configuration of the trigger pull according to an exemplary embodiment of the present disclosure. As shown in FIG. 1D, a user can pull trigger assembly 190 backward to compress biasing spring 320 and, as trigger assembly 190 is slid backwards (see backward arrow under trigger assembly 190 in FIG. 1D), inclined surface 305 is pushed backwards and, accordingly, slides plate/block 185 upward towards upper surface 315. Consequently, as plate/block 185 is pushed upward by the top camming surface (surfaces 305, 310, and 315) of trigger assembly 190 (see upward arrow in FIG. 1D), the engagement between plate/block 185 and notch/recess 180 of rod portion 175 is released as aperture 200 is moved upward to a position that clears notch/recess 180. Thus, as illustrated in FIG. 1D, spring 125 is released from its compressed state and plunger element 115 is, along with rod portion 175, forcefully pushed forward by the fully compressed spring 125 (see forward arrow in FIG. 1D) to thereby expel the primed fluids in chamber 108 out through nozzle 130. FIG. 1D shows a dashed outline 175*b* of rod portion 175 in the primed position corresponding to FIG. 1C to illustrate the range in position for rod portion 175. Again, the full compression of spring 125 shown in FIG. 1C highlights the increased firing force that is provided for by the two-step priming/pumping action according to the exemplary embodiment of the present disclosure, which reduces the strength needed to put spring 125 in the fully compressed position shown in FIG. 1C.

Although the exemplary embodiment is described in the context of a fluid launcher that utilizes fluid which may be supplied from a reservoir, it is to be understood that the two-step priming/pumping action according to the present invention could be applied to a toy projectile launcher (e.g. a dart, ball or the like) whereby the projectile is launched by air driven by a plunger or by a plunger propelling the projectile by direct contact with the plunger. In such environment the two-step priming/pumping action of the present invention enables a projectile launcher to incorporate a stronger spring without making the projectile launcher too difficult to compress.

While particular embodiments of the present disclosure have been shown and described in detail, it would be obvious to those skilled in the art that various modifications and improvements thereon may be made without departing from the spirit and scope of the disclosure. It is therefore intended to cover in the appended claims all such modifications and improvements that are within the scope of this disclosure.

What is claimed is:

1. A toy launcher comprising:

a telescopic barrel having a front part and a rear part;

a plunger element engaged by the telescopic barrel;

a compression spring that biases the plunger element against a rear wall of the telescopic barrel; and a cocking slide coupled to the telescopic barrel and the plunger element, the cocking slide being movable between a forward position and a backward position;

wherein, when the cocking slide is moved from the forward position to the backward position, the plunger element pushes the compression spring backwards to partially compress the compression spring against the rear wall of the telescopic barrel from a first partially compressed state to a second partially compressed state, the compression spring being more compressed in the second partially compressed state as compared to the first partially compressed state; and wherein, when the cocking slide is moved from the backward position to the forward position, the rear part of the telescopic barrel pushes the compression spring against the plunger element to fully compress the compression spring against the rear wall of the telescopic barrel.

2. The toy launcher of claim 1, wherein, when the cocking slide is moved from the forward position to the backward position, the telescopic barrel extends from a shorter length to a longer length.

3. The toy launcher of claim 2, wherein, when the cocking slide is moved from the backward position to the forward position, the telescopic barrel is compressed from the longer length to the shorter length.

4. The toy launcher of claim 1, further comprising:

a latching assembly; and a trigger assembly;

wherein the plunger element is coupled to the trigger assembly, and wherein a fluid chamber is formed by the plunger element and the front part of the telescopic barrel.

5. The toy launcher of claim 4, further comprising an inlet into the fluid chamber, wherein, when the cocking slide is moved from the forward position to the backward position, a fluid is drawn into the fluid chamber from via the inlet.

6. The toy launcher of claim 5, further comprising a nozzle, wherein the nozzle has incorporated thereon a one-way flow valve that reduces air intake into the fluid chamber when the plunger element is moved toward the backward position.

7. The toy launcher of claim 6, wherein, when the coupling between the trigger assembly and the plunger element is released, the plunger element is pushed forward by the compression spring to expel the fluid from the fluid chamber through the nozzle.

8. The toy launcher of claim 5, wherein the fluid is a liquid.

9. The toy launcher of claim 5, wherein the fluid is air.

10. The toy launcher of claim 1, further comprising a rod extending from the plunger element, wherein the rod incorporates a catch element thereon, and wherein, when the cocking slide is moved from the forward position to the backward position, the cocking slide engages the catch element of the rod and moves the rod in a backward direction to cause the plunger element to partially compress the compression spring against the rear wall of the telescopic barrel.

11. The toy launcher of claim 10, wherein the rod further incorporates a notched recess and a leading sloped edge, wherein the latching assembly includes an aperture and a spring-loaded plate, and wherein the plunger element is coupled to the trigger assembly via the latching assembly when the leading sloped edge of the rod engages the spring-loaded plate to push through the aperture of the latching assembly and the spring-loaded plate of the latching assembly engages the notched recess of the rod.

* * * * *